US012398892B2

(12) United States Patent
Kim et al.

(10) Patent No.: US 12,398,892 B2
(45) Date of Patent: Aug. 26, 2025

(54) AIR CONDITIONER

(71) Applicant: Samsung Electronics Co., Ltd., Suwon-si (KR)

(72) Inventors: Hyunho Kim, Suwon-si (KR); Jihong Kim, Suwon-si (KR); Hongyeol Moon, Suwon-si (KR); Wooyoung Park, Suwon-si (KR); Byungyul So, Suwon-si (KR); Mingu Jeon, Suwon-si (KR); Changwoo Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 18/442,453

(22) Filed: Feb. 15, 2024

(65) Prior Publication Data

US 2024/0183546 A1 Jun. 6, 2024

Related U.S. Application Data

(63) Continuation of application No. 17/007,627, filed on Aug. 31, 2020, now Pat. No. 11,940,160.

(30) Foreign Application Priority Data

Aug. 30, 2019 (KR) ..... 10-2019-0107583

(51) Int. Cl.
*F24F 1/0076* (2019.01)
*F24F 1/0047* (2019.01)
(Continued)

(52) U.S. Cl.
CPC ..... *F24F 1/0076* (2019.02); *F24F 1/0073* (2019.02); *F24F 11/88* (2018.01);
(Continued)

(58) Field of Classification Search
CPC ..... F24F 1/0076; F24F 1/0073; F24F 11/88; F24F 13/20; F24F 13/28; F24F 1/0047; F24F 2221/14; B66D 1/12
(Continued)

(56) References Cited

U.S. PATENT DOCUMENTS

2009/0165432 A1 7/2009 Yabu et al.
2012/0085426 A1 4/2012 Kent
(Continued)

FOREIGN PATENT DOCUMENTS

CN 101639250 B * 10/2012
EP 2080958 7/2009
(Continued)

OTHER PUBLICATIONS

Extended European Search Report dated Jan. 25, 2021 in European Patent Application No. 20193433.8.
(Continued)

*Primary Examiner* — Allen R. B. Schult
*Assistant Examiner* — William C Weinert
(74) *Attorney, Agent, or Firm* — STAAS & HALSEY LLP

(57) ABSTRACT

An air conditioner includes a housing comprising an outlet, a panel attachable to or detachable from a lower side of the housing, the panel comprising an inlet to introduce air therethrough, a first filter installable to the panel to filter the introduced air, a second filter installable to the panel at an upper side of the first filter and configured to further filter the introduced air, and a lifter configured to detach the panel from the lower side of the housing by lowering the panel from an initial position to a maintenance position in a vertical direction, and to attach the panel to the lower side of the housing by lifting the panel from the maintenance position to the initial position in the vertical direction. By
(Continued)

lowering the panel to the maintenance position, one or more of the first filter and the second filter are accessible for the maintenance.

8 Claims, 13 Drawing Sheets

(51) Int. Cl.
*F24F 1/0073* (2019.01)
*F24F 11/88* (2018.01)
*F24F 13/20* (2006.01)
*F24F 13/28* (2006.01)

(52) U.S. Cl.
CPC ..... *F24F 13/20* (2013.01); *F24F 13/28* (2013.01); *F24F 1/0047* (2019.02); *F24F 2221/14* (2013.01)

(58) Field of Classification Search
USPC ..... 454/370
See application file for complete search history.

(56) References Cited

U.S. PATENT DOCUMENTS

| | | | |
|---|---|---|---|
| 2014/0357177 | A1 | 12/2014 | Stewart, Jr. |
| 2014/0373493 | A1 | 12/2014 | Cannon |
| 2017/0151526 | A1 | 6/2017 | Cole |
| 2020/0009577 | A1 | 1/2020 | Hepperle |
| 2020/0398207 | A1 | 12/2020 | Park |
| 2021/0356355 | A1* | 11/2021 | Tanaka ..... G01M 11/0271 |

FOREIGN PATENT DOCUMENTS

| | | | |
|---|---|---|---|
| EP | 2574858 | | 4/2013 |
| JP | 2923150 | | 7/1999 |
| JP | 11-325555 | | 11/1999 |
| JP | 2000-88340 | | 3/2000 |
| JP | 3293467 | B2 | 4/2002 |
| JP | 2003-194394 | | 7/2003 |
| JP | 3848748 | | 9/2006 |
| JP | 3848748 | B2 * | 11/2006 |
| JP | 4395990 | | 10/2009 |
| JP | 4434706 | | 1/2010 |
| JP | 2011-257026 | A | 12/2011 |
| JP | 2013-138980 | A | 7/2013 |
| JP | 2017-161136 | | 9/2017 |
| KR | 20-1995-0006257 | | 8/1995 |
| KR | 10-0347927 | | 8/2002 |
| KR | 10-2003-0020593 | | 3/2003 |
| KR | 10-0814697 | | 3/2008 |
| KR | 10-2010-0077951 | | 7/2010 |
| KR | 10-1093763 | B1 | 12/2011 |
| KR | 10-2013-0045969 | A | 5/2013 |
| KR | 10-1575947 | | 12/2015 |
| KR | 20180108131 | A * | 3/2017 |
| KR | 10-2018-0108131 | | 10/2018 |
| KR | 10-2043379 | B1 | 11/2019 |

OTHER PUBLICATIONS

International Search Report dated Dec. 30, 2020 in International Patent Application No. PCT/KR2020/011435.
Office Action dated Mar. 21, 2022 in European Patent Application No. 20 193 433.8.
Non-Final Office Action dated Sep. 29, 2022 issued in U.S. Appl. No. 17/007,627.
Final Office Action dated Mar. 16, 2023 issued in U.S. Appl. No. 17/007,627.
Non-Final Office Action dated Jun. 7, 2023 issued in U.S. Appl. No. 17/007,627.
Office Action dated Jun. 6, 2023 issued in European Application No. 20 193 433.8.
Notice of Allowance dated Nov. 15, 2023 issued in U.S. Appl. No. 17/007,627.
Notice of Allowance dated Feb. 2, 2024 issued in Korean Application No. 10-2019-0107583.
Office Action dated Nov. 15, 2023 issued in Korean Application No. 10- 2019-0107583.
Office Action dated Nov. 30, 2023 issued in Japanese Application No. 202010894694.3.
Keystone (Keystone 209 Battery Contact (10 pieces)—Amazon.com. https://www.amazon.com/KEYSTONE-209-BATTERY-CONTACT-pieces/dp/BOOLPOVJHS (Year: 2015).
U.S. Appl. No. 17/007,627, filed Aug. 31, 2020, Hyunho Kim, Samsung Electronics Co., Ltd.
Office Action dated Dec. 10, 2024 issued in Korean Application No. 10-2024-0058379.

* cited by examiner

AIR CONDITIONER

CROSS-REFERENCE TO RELATED APPLICATIONS

This application is a continuation of U.S. Ser. No. 17/007,627, filed Aug. 31, 2020, and claims priority under 35 U.S.C. § 119 to Korean Patent Application No. 10-2019-0107583, filed on Aug. 30, 2019, in the Korean Intellectual Property Office, the disclosure of which is incorporated by reference herein in its entirety.

BACKGROUND

1. Field

The disclosure relates to an air conditioner, and more particularly, to an air conditioner including an improved lifting and lowering structure of a panel.

2. Description of the Related Art

In general, an air conditioner is a household appliance that maintains indoor air at a comfortable temperature by using a refrigeration cycle of a refrigerant. The air conditioner is composed of an indoor unit that is placed in the indoor space and provided with a heat exchanger and a blower fan, an outdoor unit that is placed in the outdoor space and provided with a compressor and a condenser, and a refrigerant pipe that connects the indoor unit to the outdoor unit and circulates a refrigerant.

Recently, an air conditioner, in which a dust collecting filter is additionally installed due to difficulties such as fine dust, so as to maintain a comfortable temperature in the indoor space while purifying indoor air, has been disclosed.

According to the installation location of the indoor unit, the air conditioner may be classified into a stand-type air conditioner in which the indoor unit is placed on a floor, a wall-mount type air conditioner in which the indoor unit is installed on a wall, and a ceiling-type air conditioner in which the indoor unit is installed on a ceiling. The ceiling-type air conditioner is provided to be embedded in the ceiling or suspended from the ceiling.

It is difficult to perform maintenance on a filter disposed in the inside of the indoor unit, because the indoor unit of the ceiling-type air conditioner is installed on the ceiling.

SUMMARY

Therefore, it is an aspect of the disclosure to provide an air conditioner capable of allowing a panel and a filter of an indoor unit to be lifted and lowered so as to easily perform maintenance on the filter.

It is another aspect of the disclosure to provide an air conditioner capable of allowing an electrostatic precipitator filter, which is configured to collect foreign substances using electricity, to be lifted and lowered along with a panel.

It is another aspect of the disclosure to provide an air conditioner capable of easily supplying electricity to an electrostatic precipitator filter, which is configured to be lifted and lowered, when the electrostatic precipitator filter is inserted into a housing.

Additional aspects of the disclosure will be set forth in part in the description which follows and, in part, will be apparent from the description, or may be learned by practice of the disclosure.

In accordance with an aspect of the disclosure, an air conditioner includes a housing including an outlet, a panel attachable to or detachable from a lower side of the housing and including an inlet to introduce air therethrough, a first filter installable to the panel, a second filter installable to the panel to filter the introduced air and configured to further filter the introduced air using an electrostatic force, and a lifter configured to detach the panel from the lower side of the housing by lowering the panel from an initial position, and to attach the panel to the lower side of the housing by lifting the panel from a maintenance position. When the panel is lowered to the maintenance position, one or more of the first filter and the second filter are accessible for maintenance thereon.

The second filter is an electrostatic precipitator filter and the air conditioner. The air conditioner may further include a power supply disposed inside of the housing and configured to supply power to the second filter to generate the electrostatic force to filter the introduced air.

The panel, the first filter and the second filter installed in the panel may be lifted or lowered in a vertical direction while maintaining a horizontal state The second filter may include a contact portion configured to be in contact with the power supply in an up and down direction.

The contact portion may be disposed on an upper portion of the second filter.

The power supply may include an intermediate member configured to be in contact with the contact portion electrically by being pressed by the contact portion when the panel is lifted from the maintenance position.

The intermediate member may be a plate spring member.

The panel, the first filter and the second filter may be lifted or lowered in the vertical direction while maintaining the horizontal state.

The housing further may include a guide configured to guide a lifting direction of the panel to allow the contact portion to be in contact with the power supply in the up and down direction.

The guide may include a guide surface configured to guide the lifting direction of the panel by contacting with at least a part of the panel upon lifting of the panel.

The guide may include a guide rib configured to guide the lifting direction of the panel by contacting with at least a part of the panel upon lifting of the panel.

The panel may further include a frame configured to support the first filter and the second filter against the panel.

The second filter may be installed to the panel in a first direction corresponding to a lifting and lowering direction of the second filter, and the first filter may be installed to the panel in a second direction perpendicular to the first direction.

The lifter may include four motors, and four wires connected to the four motors and connected to the panel to lift or lower the panel by driving force of the four motors.

The lifter may include a motor, and a wire including one end connected to the motor and an other end connected to the panel, the wire configured to lift or lower the panel by driving force of the motor, and the panel may include an elastic member including one end connected to an other end of the wire and the other end connected to the panel.

The panel may further include a pulley through which the wire passes, and the other end of the wire may pass through the pulley and then be arranged perpendicular to the one end of the wire.

In accordance with another aspect of the disclosure, an air conditioner includes a housing including an outlet, a panel assembly attachable to or detachable from a lower side of the housing and configured to be moved in an up and down direction with respect to the housing, and a lifter disposed inside of the housing and configured to lift or lower the panel assembly in a vertical direction while maintaining a horizontal state of the panel assembly. The panel assembly includes a panel including an inlet to introduce air therethrough and configured to cover the lower side of the housing, a first filter installable to the panel and configured to filter the introduced air, and a second filter instalalbe to the panel and configured to further filter the introduced air using an electrostatic force.

The second filter is an electrostatic precipitator filter and the air conditioner. The air conditioner may further include a power supply disposed inside of the housing and configured to supply power to the second filter to generate the electrostatic force to filter the introduced air, and the second filter may include a contact portion configured to be in contact with the power supply in an up and down direction.

The contact portion may be disposed on an upper portion of the second filter.

The lifter may include four motors, and four wires connected to the four motors and connected to the panel to lift or lower the panel by driving force of the four motors.

In accordance with another aspect of the disclosure, an air conditioner includes a housing including an outlet, a panel attachable to or detachable from a lower side of the housing and including an inlet to introduce air therethrough, a first filter installable to the panel, a second filter installable to the panel and configured to filter out the introduced air using an electrostatic force, and a lifter configured to detach the panel from the lower side of the housing by lowering the panel from an initial position, and to attach the panel to the lower side of the housing by lifting the panel from a maintenance. The second filter includes a contact portion disposed on an upper portion of the second filter and configured to receive power therethrough.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
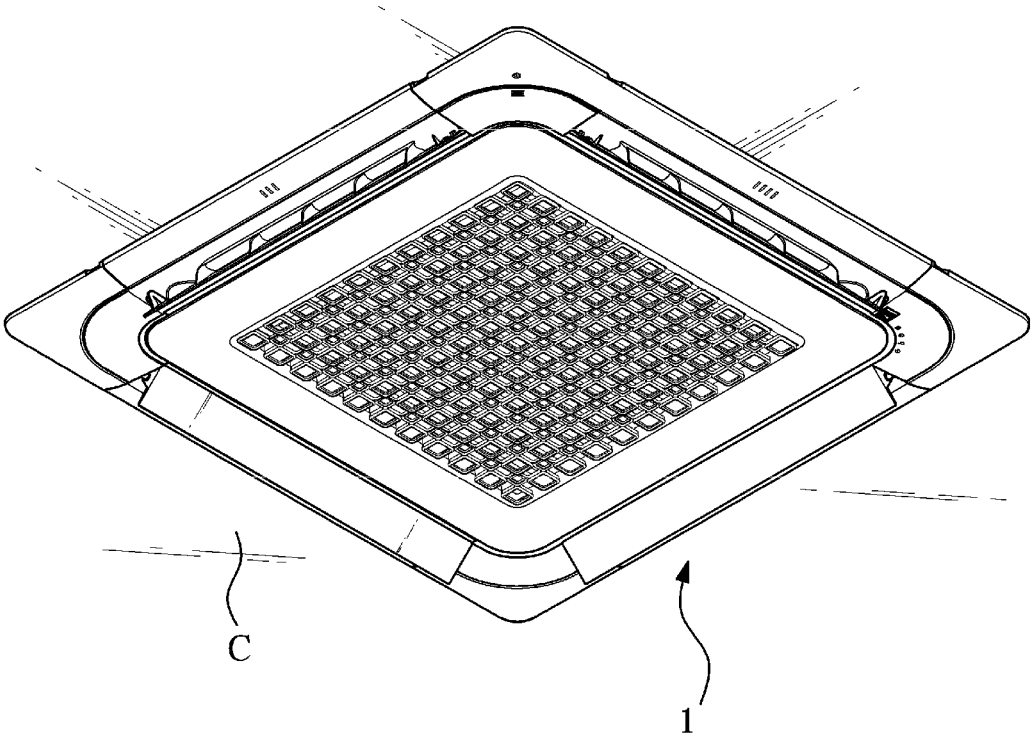
FIG. 1 is a perspective view of an air conditioner according to an embodiment of the disclosure.

Embodiments described in the disclosure and configurations illustrated in the drawings are merely examples of the embodiments of the disclosure, and may be modified in various different ways at the time of filing of the present application to replace the embodiments and drawings of the disclosure.

In addition, the same reference numerals or signs illustrated in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

The term of "and/or" includes a plurality of combinations of relevant items or any one item among a plurality of relevant items.

In the following detailed description, the terms of "upper portion", "lower portion", "lower side", "front end" and "front, rear, left and right side" may be defined by the drawings, but the shape and the location of the component is not limited by the term.

A refrigeration cycle forming an air conditioner is composed of a compressor, a condenser, an expansion valve, and an evaporator. The refrigeration cycle may circulate a series of processes composed of compression-condensation-expansion-evaporation, and the refrigeration cycle may be configured to supply air that is conditioned by changing heat with a refrigerant.

The compressor compresses refrigerant gas, and discharges the high temperature and high pressure refrigerant gas. The discharged refrigerant gas flows into the condenser. The condenser condenses the compressed refrigerant into a liquid phase and releases heat to the surroundings through a condensation process.

The expansion valve expands the high temperature and high pressure liquid refrigerant, which is condensed by the condenser, into a low pressure liquid refrigerant. The evaporator evaporates the refrigerant, which is expanded in the expansion valve, and returns the low temperature and low pressure refrigerant gas to the compressor. The evaporator may exchange heat with an object, which is to be cooled, by using evaporation latent heat, thereby obtaining the refrigeration effect. Through this cycle, the air conditioner may adjust a temperature of an indoor space.

An outdoor unit of an air conditioner refers to a part of the refrigeration cycle composed of a compressor and an outdoor heat exchanger. An indoor unit of an air conditioner includes an indoor heat exchanger, and an expansion valve may be located in either an indoor unit or an outdoor unit. An indoor heat exchanger and an outdoor heat exchanger serve as a condenser or an evaporator. When the indoor heat exchanger is used as the condenser, the air conditioner operates as a heater, and when the indoor heat exchanger is used as the evaporator, the air conditioner operates as a cooler.

Hereinafter embodiments according to the disclosure will be described in detail with reference to the accompanying drawings.

Figure 2:
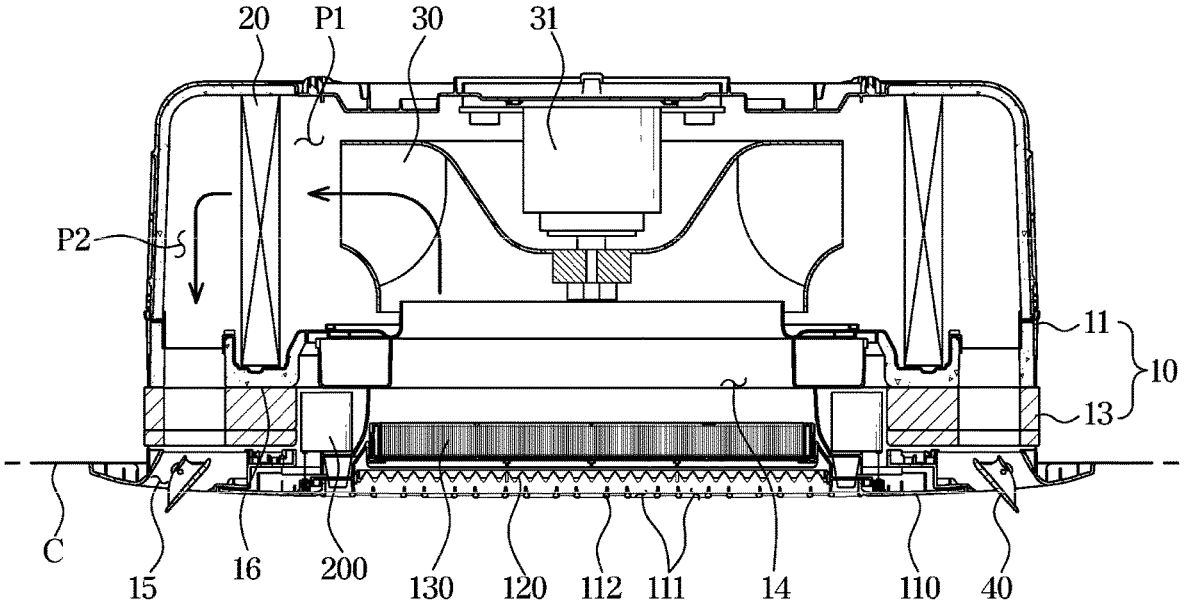
FIG. 2 is a side sectional view of the air conditioner according to an embodiment of the disclosure.
Figure 3:
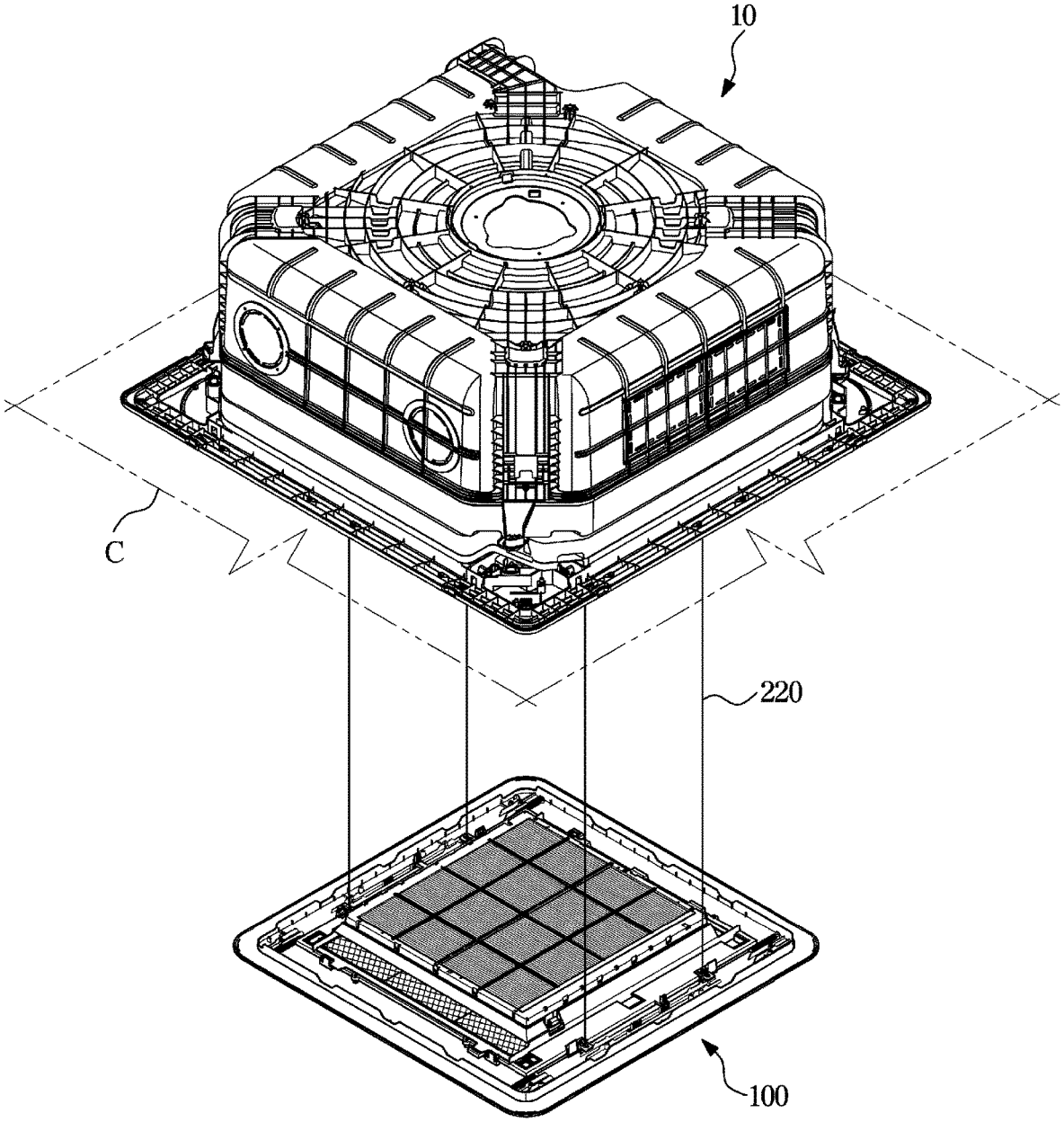
FIG. 3 is a view illustrating a state in which a panel assembly of the air conditioner of FIG. 1 is lowered.

FIG. 1 is a perspective view of an air conditioner according to an embodiment of the disclosure, FIG. 2 is a side sectional view of the air conditioner according to an embodiment of the disclosure, and FIG. 3 is a view illustrating a state in which a panel assembly of the air conditioner of FIG. 1 is lowered.

Referring to FIGS. 1 and 2, an air conditioner 1 according to an embodiment may be installed on a ceiling C. At least a part of the air conditioner 1 may be embedded in the ceiling C. The air conditioner 1 according to an embodiment of the disclosure may be provided in a 4-way type. However, the disclosure is not limited thereto, and the air conditioner 1 may be provided as an air conditioner in a 2-way type or an air condition including an outlet in an annular shape.

The air conditioner 1 may include a housing 10 including an outlet 15, a heat exchanger 20 provided in an inside of the housing 10, and a blower fan 30 configured to allow air to flow.

The housing 10 may be formed in the form of a rectangular enclosure opened downward to accommodate components of the air conditioner 1. The housing 10 may include an upper housing 11 disposed in the inside of the ceiling C and a lower housing 13 coupled to a lower side of the upper housing 11. The upper housing 11 may be suspended from the ceiling C without being disposed in the inside of the ceiling C.

However, the disclosure is not limited thereto, and the upper housing 11 and the lower housing 13 may be integrally formed as a single housing 10.

An inlet portion 14 configured to allow air, which is sucked through a panel assembly 100, to flow to the blower fan 30 may be formed on a central part of the lower housing 13. The outlet 15, through which air is discharged, may be formed on the outside of the inlet portion 14. An inlet flow path P1 through which air, which is sucked through the inlet portion 14, flows may be provided between the inlet portion 14 and the blower fan 30. An outlet flow path P2 through which air, which is discharged by the blower fan 30, flows may be provided between the blower fan 30 and the outlet 15.

The outlet 15 may be formed adjacent to each edge to correspond to an outer periphery of the lower housing 13. Four outlets 15 may be formed. That is, two outlets 15 may be formed in an X-axis direction and two outlets 15 may be formed in a Y-axis direction. The four outlets 15 may be arranged to discharge air to all four sides of the room. With this structure, the air conditioner 1 may suck air from the lower side, and cool or heat the air and then discharge the cooled or heated air to the lower side.

On the bottom surface of the lower housing 13, the panel assembly 100 including an inlet grille 112 in which a plurality of inlets 111 is formed may be arranged. Air flowing through the plurality of inlets 111 may flow toward the blower fan 30 side through the inlet portion 14.

The panel assembly 100 may be coupled to the lower housing 13. The panel assembly 100 may be provided to cover a lower side of the lower housing 13 and attachable to or detachable from the lower side of the lower housing 13.

Particularly, the panel assembly 100 may be attachable to or detachable from the housing 10 and may be configured to be lifted and lowered in an up and down direction. When the panel assembly 100 is moved downward, the panel assembly 100 may be separated from the housing 10, and when the panel assembly 100 is moved upward, the panel assembly 100 may be coupled to the housing 10, again.

A lifting and lowering device 200 configured to lift and lower the panel assembly 100 may be provided in the inside of the housing 10.

The panel assembly 100 may include a panel 110 including the plurality of inlets 111, a first filter 120 configured to remove foreign substance in air, which flows through the plurality of inlets 111, and a second filter 130 arranged above the first filter 120 and configured to secondly filter air that is filtered by the first filter 120.

The first filter 120 may be formed of a mesh material so as to filter out foreign substances. The second filter 130 may be provided as an electrostatic precipitator filter that is supplied with power so as to electrically collect foreign substance in air.

The panel assembly 100 and the lifting and lowering device 200 will be described later in detail.

The heat exchanger 20 may be formed in a square ring shape and arranged on the outer side of the blower fan 30 inside the housing 10. The heat exchanger 20 is not limited to a square ring shape, and may be provided in various shapes such as a circular, elliptical, or polygonal shape.

The heat exchanger 20 may be placed on a drain tray 16, and thus condensation water generated in the heat exchanger 20 may be collected in the drain tray 16. The drain tray 16 may be formed in a shape corresponding to the shape of the heat exchanger 20. That is, when the heat exchanger 20 is in the form of a square ring, the drain tray 16 may also be in the form of a square ring, and alternatively, when the heat exchanger 20 is in the form of a circular shape, the drain tray 16 may also be in the form of a circular shape.

The blower fan 30 may be arranged at a central portion of the housing 10. That is, the blower fan 30 may be provided in the inner side of the heat exchanger 20. The blower fan 30 may be a centrifugal fan configured to suck air in an axial direction and discharge the sucked air to a radial direction. The air conditioner 1 may be provided with a blowing motor 31 configured to drive the blower fan 30.

A blade 40 may be rotatably provided on the outlet 15. The blade 40 may guide the direction of air discharged through the outlet 15.

The panel assembly 100 may be configured to be lifted and lowered, as shown in FIG. 3.

The lifting and lowering device 200 may include a motor 210 (refer to FIG. 4) and a wire 220 including one end connected to the motor 210 and the other end connected to the panel 110.

The panel assembly 100 may be connected to the wire 220 and moved in the up and down direction through an operation in which the wire is wound and unwound by driving the motor 210. That is, when the motor 210 is rotated in one direction, the panel assembly 100 may be lowered, and when the motor 210 is rotated in an opposite direction, the panel assembly 100 may be lifted.

In order to maintain a room temperature and at the same time to purify indoor air, the air conditioner 1 includes the first filter 120 and the second filter 130. Further, in order to increase the air purification efficiency, a user may need to periodically remove foreign substances collected in the first filter 120 and the second filter 130.

At this time, the air conditioner 1 is installed on the ceiling C, and thus it may be difficult to perform maintenance on the first filter 120 and the second filter 130 of the air conditioner 1. In a conventional manner, a user may have a difficulty in which through a piece of equipment such as a ladder, the user disassembles the filter from the air conditioner, which is installed on the ceiling, to clean the filter and mount the filter to the air conditioner installed on the ceiling.

In order to relieve such a difficulty, an air conditioner in the conventional manner is disclosed, and the air conditioner is configured in such a way that by lifting and lowering a panel on which a filter is arranged, the air conditioner allows a user to easily separate the filter from the panel, which is lowered to a user's height, without directly disassembling the filter from the ceiling.

However, as for an air conditioner including an electrostatic precipitator filter according to an embodiment of the disclosure, the electrostatic precipitator filter is coupled to the housing rather than the panel because power needs to be supplied to the electrostatic precipitator filter, and a load of the electrostatic precipitator filter is heavy.

At this time, when the panel is lowered by the lifting and lowering device, a user may easily separate the filter including the mesh material that is lowered along with the panel. However, even when the panel is lowered by the lifting and lowering device, a user still needs to separate the electrostatic precipitator filter assembled to the ceiling side through a piece of equipment such as a ladder so as to perform maintenance on the electrostatic precipitator filter because the electrostatic precipitator filter is arranged in the inside of the housing embedded in the ceiling.

Particularly, the electrostatic precipitator filter is configured to collect foreign substances of a fine size and configured to have a high dust collecting rate. Therefore, in order to increase air cleaning efficiency, the electrostatic precipitator filter is required to manage foreign substances collected in the filter on a certain period shorter than that of a general filter. However, as described above, in the conventional manner, the electrostatic precipitator filter is arranged in the inside of the housing embedded in the ceiling, and thus maintenance of the electrostatic precipitator filter is more difficult than that of the general filter.

To relieve this difficulty, the air conditioner 1 according to an embodiment of the disclosure includes the filter assembly 100 configured to be lifted and lowered from the ceiling C, and the filter assembly 100 includes the first filter 120 including a mesh material and the second filter 130 provided as the electrostatic precipitator filter configured to collect foreign substances in the air using electricity. Accordingly, when a user lowers the filter assembly 100, the user can easily perform maintenance on the filter 120 including a mesh material and the second filter 130 provided as the electrostatic precipitator filter.

Particularly, because the panel assembly 100 including the first filter 120 and the second filter 130 is configured to be lifted and lowered by the lifting and lowering device 200, the panel 110, the first filter 120 and the second filter 130 may be integrally lifted and lowered and thus a user can separate the second filter 130 as well as the first filter 120 from the air conditioner 1 and perform maintenance on the second filter 130 as well as the first filter 120.

Hereinafter the panel assembly 100 and the lifting and lowering device 200 will be described in detail.

Figure 4:
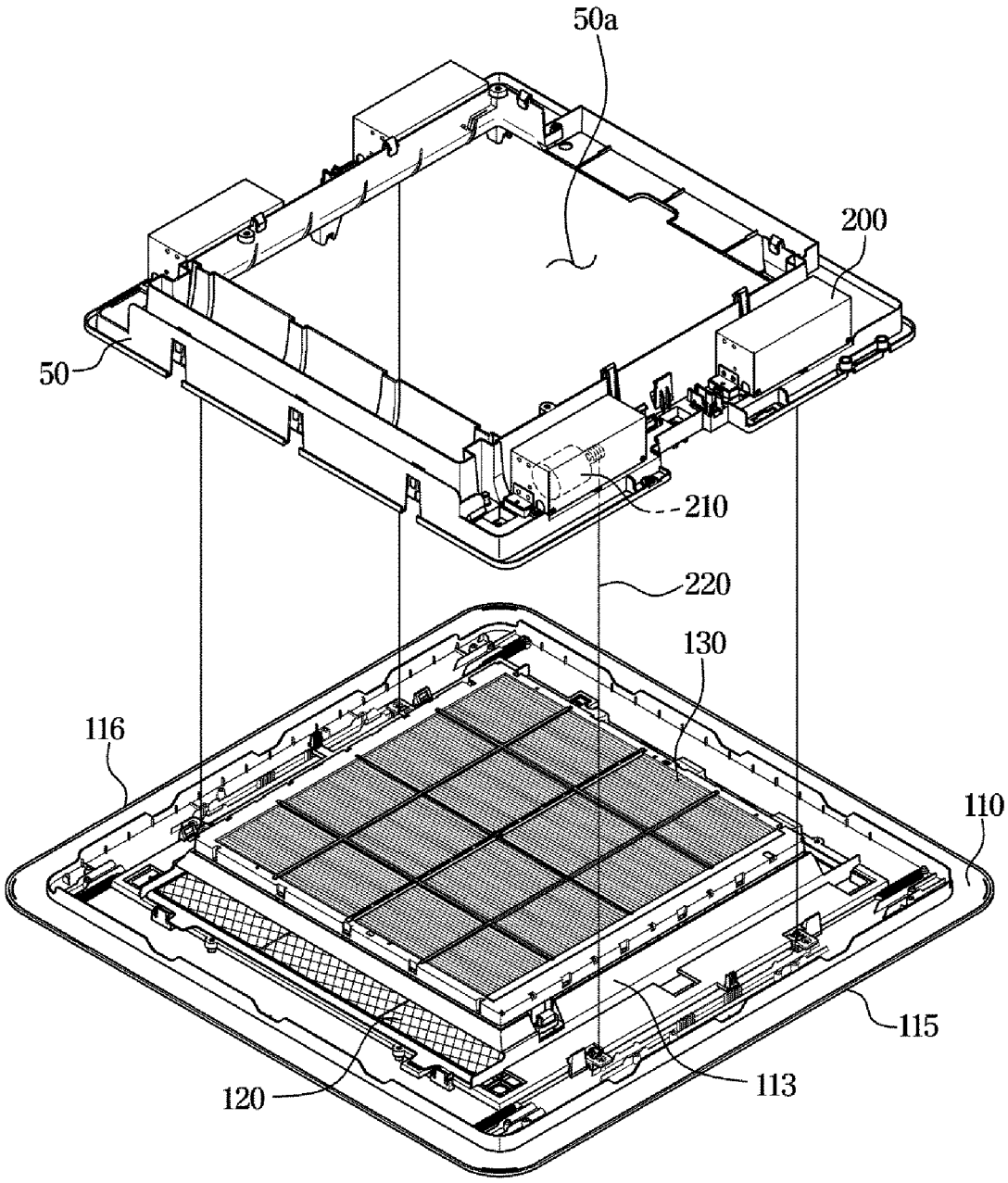
FIG. 4 is a view illustrating a part of configuration of the air conditioner of FIG. 3.
Figure 5:
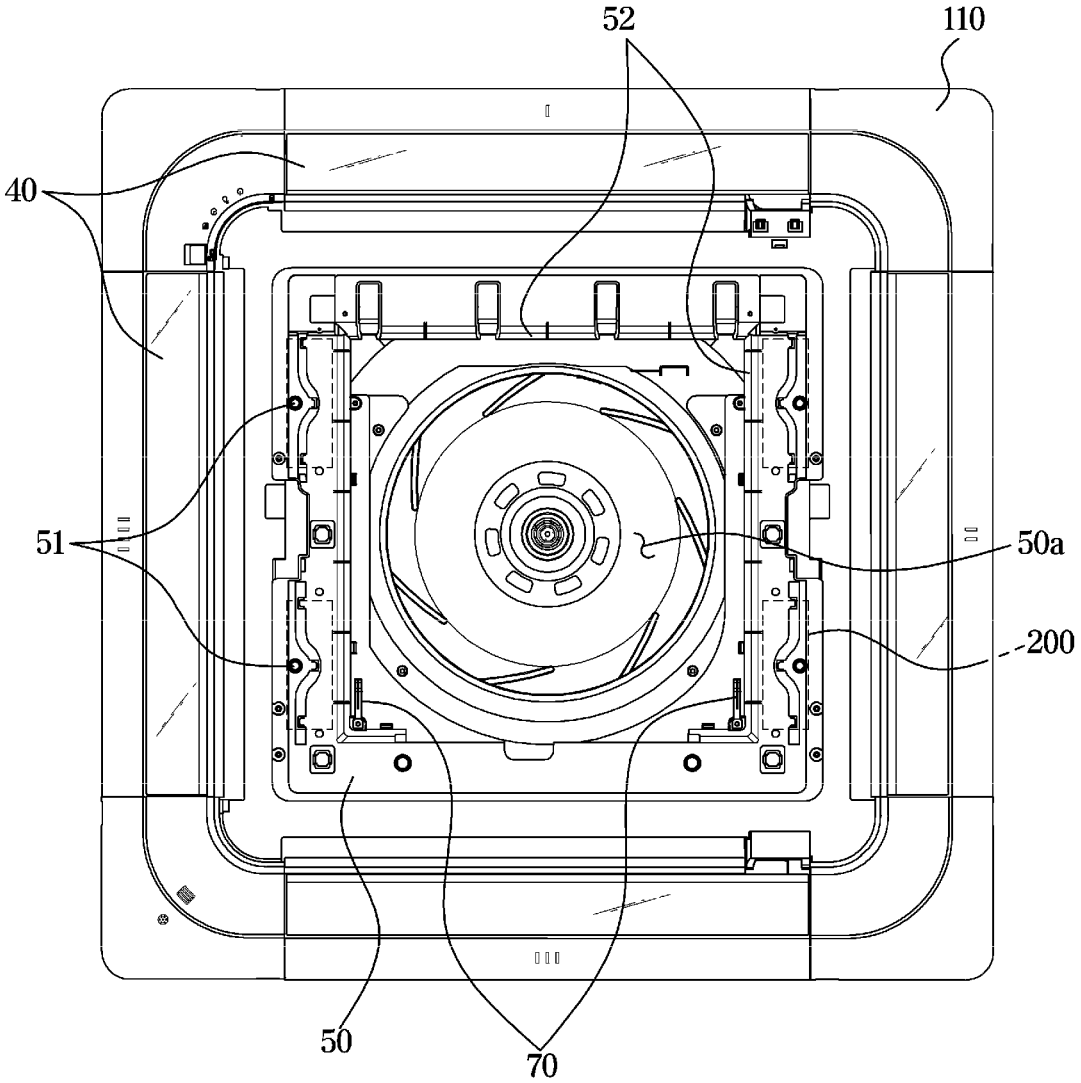
FIG. 5 is a bottom view of a housing of the air conditioner according to an embodiment of the disclosure.
Figure 6:
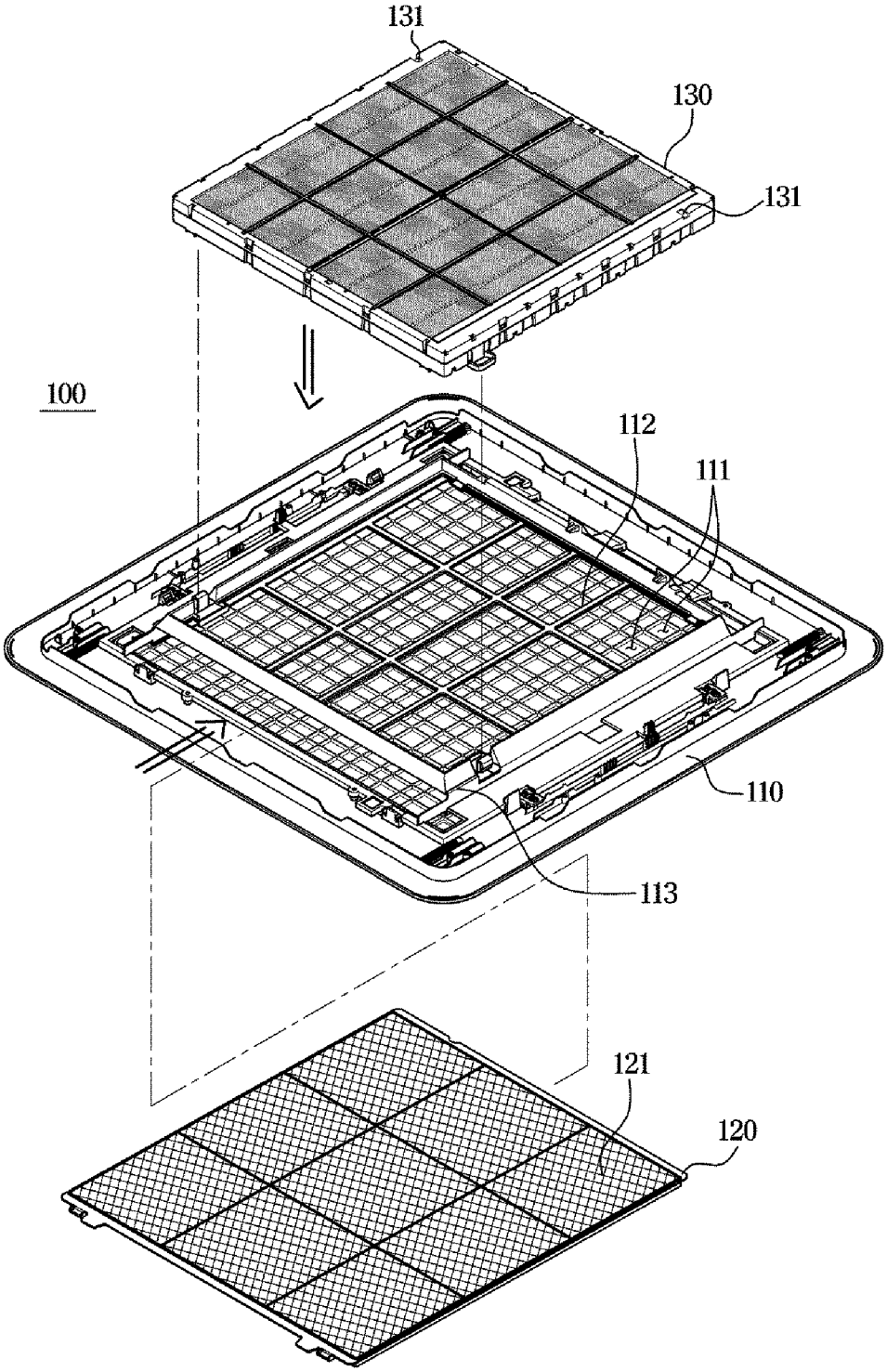
FIG. 6 is an exploded perspective view of the panel assembly of the air conditioner according to an embodiment of the disclosure.
Figure 7:
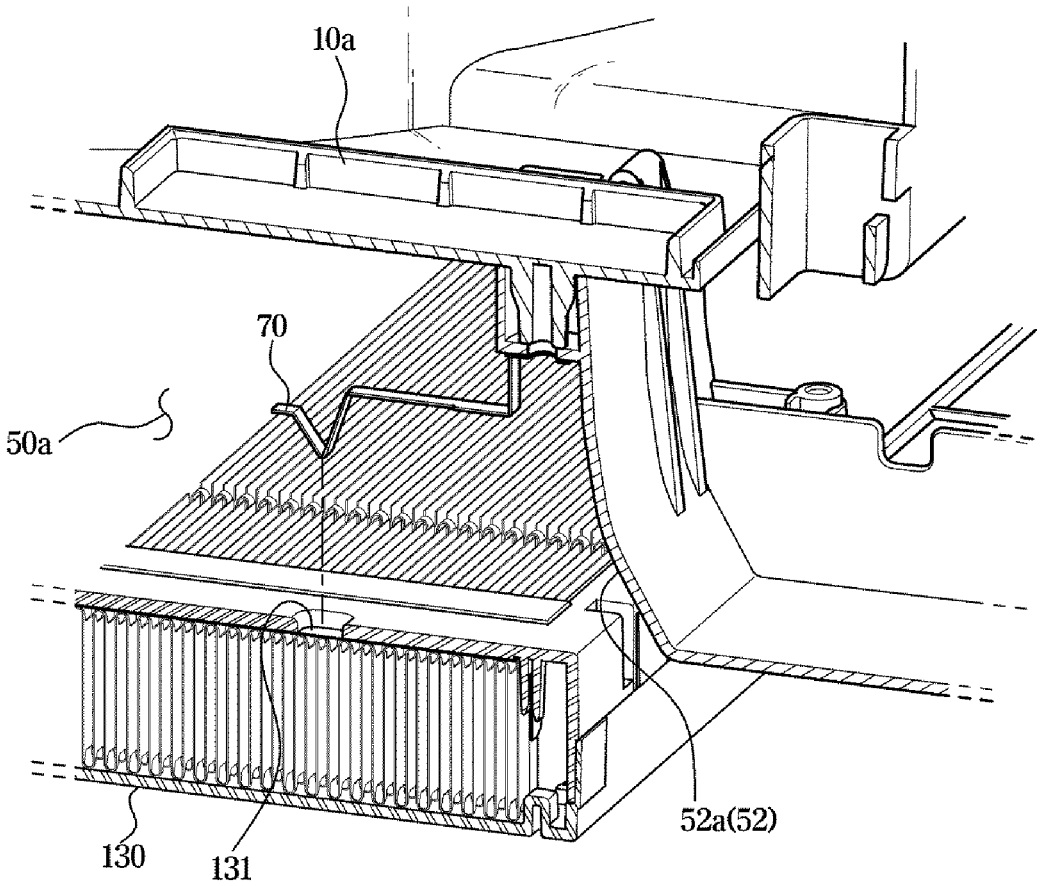
FIG. 7 is a cross-sectional perspective view illustrating a part of configuration when the panel assembly of the air conditioner according to an embodiment of the disclosure is lifted.

FIG. 4 is a view illustrating a part of configuration of the air conditioner of FIG. 3, FIG. 5 is a bottom view of a housing of the air conditioner according to an embodiment of the disclosure, FIG. 6 is an exploded perspective view of the panel assembly of the air conditioner according to an embodiment of the disclosure, and FIG. 7 is a cross-sectional perspective view illustrating a part of configuration when the panel assembly of the air conditioner according to an embodiment of the disclosure is lifted.

As illustrated in FIGS. 4 and 5, the air conditioner 1 may include a support panel 50 provided in a central part of the lower housing 13. The lifting and lowering device 200 may be arranged above the support panel 50.

However, the disclosure is not limited thereto, and the support panel 50 may be integrally formed with the lower housing 13 as a part of the lower housing 13, and alternatively, the support panel 50 may be integrally formed with the housing 10 as a part of the housing 10.

The lifting and lowering device 200 may include a plurality of motors 210. It is appropriate that the lifting and lowering device 200 may include four motors 210. The panel assembly 100 may be stably lifted and lowered because four motors 210 are provided.

The wire 220 may be connected to each motor 210. Accordingly, it is appropriate that four wires 220 are provided. One end of each of the four wires 220 may be connected to each motor 210 and the other end of each of the four wires 220 may be connected to the panel 110, respectively.

This is because the panel assembly 100 includes the second filter 130 having a relatively large load and thus a relatively large force is required to lift the panel assembly 100. In addition, through the four wires 220 connected to the four motors 210, the four motors 210 may lift and lower the panel assembly 100 while maintaining the balance with respect to a horizontal direction of the panel assembly 100.

Two of the four wires 220 may be connected to a vicinity of a first side 115 of the panel 110 and the other two of the four wires 220 may be connected to a vicinity of a second side 116 parallel to the first side 115 of the panel 110.

The two wires 220 connected to the vicinity of the first side 115 and the two wires 220 connected to the vicinity of the second side 116 may be symmetrically connected to the panel 110 with respect to the central part of the panel 110.

Accordingly, when the panel assembly 100 is lifted and lowered, the lifting and lowering device 200 may lift and lower the panel assembly 100 in a balanced manner without being inclined to one side.

As the panel assembly 100 is lifted and lowered by the four wires 220, the panel 110, the first filter 120, and the second filter 130 may be lifted and lowered in a state of being arranged in a vertical direction with respect to a lifting and lowering direction.

That is, the panel assembly 100 may be lifted and lowered in a horizontal state, and thus the first filter 120 and the second filter 130 may also be lifted and lowered in the horizontal state. Accordingly, the panel assembly 100 may be lowered to a range in which a user can hold the panel assembly 100 and thus the user may easily separate the first filter 120 and the second filter 130 from the panel 110.

This is because when the first filter 120 or the second filter 130 is lowered in an inclined state, it is difficult for the user to hold each of the filters 120 and 130 and thus it is difficult for the user to separate the filters 120 and 130 from the panel 110.

In addition, because the user presses the panel 110 upon separating the filters 120 and 130, it is possible to prevent the filter assembly 100 from being severely moved in a direction in which the user presses the panel 110.

The support panel 50 may include a through hole 51 provided to allow the wire 220 to penetrate and extend downward. The through hole 51 may be provided to correspond to the number of the wire 220. According to an embodiment of the disclosure, four through holes 51 may be provided. The support panel 50 may include a guide 52 configured to guide a lifting direction of the panel assembly 100, which is described later.

The central part of the support panel 50 may include an opening 50*a* provided to allow air sucked through the panel assembly 100 to flow.

The second filter 130 may be inserted into the opening 50*a* upon the coupling between panel assembly 100 and the housing 10.

The panel assembly 100 may include the panel 110 configured to cover the lower side of the housing 10 as described above.

The panel 110 may include the inlet grille 112 forming the plurality of inlets 111. The upper side of the panel 110 may include a frame 113 provided to allow the first filter 120 and the second filter 130 to be coupled thereto.

The first filter 120 may be arranged above the inlet grille 112 and the second filter 130 may be arranged above the first filter 120. Accordingly, the inlet grille 112, the first filter 120 and the second filter 130 may be arranged to be stacked in the up and down direction.

The second filter 130 may be separated from and coupled to the frame 113 the up and down direction corresponding to the lifting and lowering direction of the filter assembly 100.

The first filter 120 may be separated from and coupled to the frame 113 in a direction perpendicular to the up and down direction.

Alternatively, each of the filters 120 and 130 may has a separating direction and a coupling direction different from each other and thus the filters 120 and 130 may be separated from and coupled to the frame 113 independently of each other without limitation in each of the separation and coupling state.

The first filter 120 may include a mesh member 121. The mesh member 121 may be arranged on the first filter 120 in a zig-zag shape in the up and down direction to maximize a surface area (refer to FIG. 2).

When the air is sucked into the filter assembly 100, foreign substances having a predetermined size may be filtered out by the mesh member 121 while passing through the first filter 120. However, foreign substances having a size smaller than the through hole of the mesh member 121 may pass through the first filter 120.

The foreign substances having a size smaller than the through hole of the mesh member 121 may be filtered out by the second filter 130. That is, the air sucked into the air conditioner 1 may be filtered twice while passing through the panel assembly 100 and thus the foreign substances in the air may be efficiently collected in the panel assembly 100.

The second filter 130 may be provided as an electrostatic precipitator filter as described above.

The electrostatic precipitator filter may adsorb foreign substances in the charged air and electrically collect the foreign substances in the air.

Accordingly, the second filter 130 may need to be supplied with high-voltage power to electrically collect foreign substances in the air.

When the electrostatic precipitator filter corresponding to the second filter 130 is disposed in the inside of the housing in the conventional manner, it is possible to stably supply a high voltage to the electrostatic precipitator filter. However, the air conditioner 1 according to an embodiment of the disclosure has a difficulty in supplying a high voltage to the second filter 130 because the second filter 130 is detachable from the housing 10 and lifted and lowered in the up and down direction.

To relieve this difficulty, the air conditioner according to an embodiment of the disclosure may include a power supply (not shown) configured to stably supply a voltage to the second filter 130 in response to the coupling between the panel assembly 100 and the housing 10.

As illustrated in FIGS. 5 to 7, the power supply (not shown) may include an intermediate member 70 disposed in an inside 10*a* of the housing 10 and configured to supply a voltage to the second filter 130 in response to the coupling between the panel assembly 100 and the housing 10. Particularly, the intermediate member 70 may be arranged in the inside of the opening 50*a* of the support panel 50.

However, the disclosure is not limited thereto, and the intermediate member 70 may be disposed on the support panel 50.

Although not shown in the drawing, a power supply (not shown) may be also disposed in the inside 10*a* of the housing 10 and configured to supply a high voltage to the second filter 130 through the intermediate member 70 by receiving power supplied from the outside. In addition, the power supply (not shown) may be disposed above the support panel 50.

The intermediate member 70 may be electrically connected to the second filter 130 and supply the power to the second filter 130 when the panel assembly 100 is lifted and the panel assembly 100 and the housing 10 are coupled to each other.

When the panel assembly 100 is lowered, the electrical connection between the intermediate member 70 and the second filter 130 may be released and the supply of power to the second filter 130 may be blocked.

The second filter 130 may include a contact portion 131 configured to be in contact with the intermediate member 70 electrically in response to the coupling between the panel assembly 100 and the housing 10. As described above, the intermediate member 70 is disposed in the inside of the opening 50*a* of the support panel 50, and the second filter 130 may be inserted into the inside of the opening 50*a* of the support panel 50 in response to the coupling between the panel assembly 100 and the housing 10. Accordingly, the intermediate member 70 may be in contact with the contact portion 131 in response to the coupling between the panel assembly 100 and the housing 10.

In response to the coupling between the panel assembly 100 and the housing 10, the contact portion 131 may be lifted to a position in which the contact portion 131 is in contact with the intermediate member 70 by pressing the intermediate member 70. The contact portion 131 and the intermediate member 70 may be disposed on the same line in the up and down direction.

The contact portion 131 is a portion in which a contact point is formed by being in physical contact with the intermediate member 70.

The contact portion 131 may be supplied with a voltage from the intermediate member 70 upon being in contact with the intermediate member 70, and when the contact point is shorted upon the release of the contact between the contact portion 131 and the intermediate member 70, the supply of voltage may be blocked.

The contact portion 131 may be disposed toward the lifting and lowering direction of the panel assembly 100. Accordingly, the contact portion 131 may be in contact with the intermediate member 70 in the lifting direction of the panel assembly 100.

It is appropriate that the contact portion 131 is disposed on an upper surface of the second filter 130. Therefore, upon the lifting of the second filter 130, the second filter 130 may be in contact with the intermediate member 70 by pressing the intermediate member 70 in the lifting direction. Upon the lowering of the second filter 130, the pressure applied to the intermediate member 70 may be released and the contact with the intermediate member 70 may be released.

The intermediate member 70 may be provided in a plate spring shape. Accordingly, when the contact portion 131 is lifted and in contact with the intermediate member 70, the contact portion 131 may press the intermediate member 70 upward and the intermediate member 70 may be biased downward. Therefore, the intermediate member 70 may be maintained at a state of being in constant contact with the contact portion 131.

That is, the contact point formed on the second filter 130 may be formed in the lifting and lowering direction or the up and down direction. Accordingly, the contact point with the intermediate member 70 may be stably formed even when the second filter 130 is lifted and lowered in the up and down direction. As a result, the second filter 130 may be electrically connected to the power supply (not shown) stably.

Therefore, even when the second filter 130 is movable with the panel 110, the second filter 130 may be stably supplied with the voltage through the contact point formed in a moving direction. Therefore, when the second filter 130 is lowered to a range in which a user generally holds and then the second filter 130 is lifted and arranged in the inside of the housing 30, the contact point with the intermediate member 70 may be stably formed and thus the second filter 130 may be stably supplied with the power.

The power supply (not shown) may include a power supply device configured to supply power and a high voltage device configured to generate a high voltage using the supplied power and transmit the high voltage to the intermediate member 70.

At this time, as for the air conditioner 1 according to an embodiment of the disclosure, both the power supply device and the high voltage device of the power supply (not shown) may be installed on the upper side of the support panel 50 or in the inside 10*a* of the housing 10. The high voltage device may be electrically connected to the second panel 130 through the intermediate member 70.

However, the disclosure is not limited thereto, and the high voltage device among the power supply (not shown) may be disposed in the panel assembly 100 and lifted and lowered together with the panel assembly 100.

At this time, the high voltage device disposed in the panel assembly 100 may be maintained in the electrical connection with the second filter 130, and when the second filter 130 is inserted into the inside 10*a* of the housing 10, the second filter 130 may be electrically connected to the power supply device through the intermediate member 70.

That is, a part of the power supply (not shown) may be disposed in the panel assembly 100 and then lifted and lowered along with the panel assembly 100. The supply of power to some components of the power supply (not shown) may be blocked upon the lowering, and when the panel assembly 100 is lifted and then coupled to the housing 10, the some components of the power supply (not shown) may be in contact with the intermediate member 70 arranged in the housing 10, thereby receiving the power.

Hereinafter the guide 52 configured to guide the lifting direction of the panel assembly 100 will be described in detail.

Figure 8:
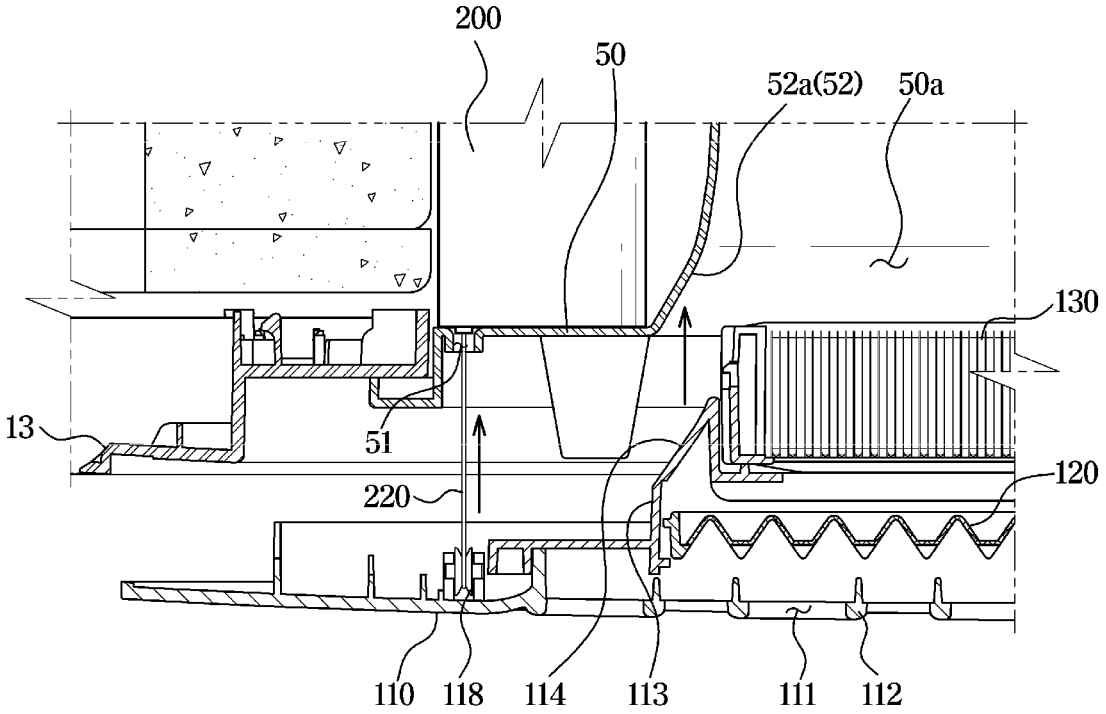
FIG. 8 is a cross-sectional view illustrating a part of configuration when the panel assembly of the air conditioner according to an embodiment of the disclosure is lifted.

FIG. 7 is a cross-sectional perspective view illustrating a part of configuration when the panel assembly of the air conditioner according to an embodiment of the disclosure is lifted, and FIG. 8 is a cross-sectional view illustrating a part of configuration when the panel assembly of the air conditioner according to an embodiment of the disclosure is lifted.

As mentioned above, the panel assembly 100 may be lifted and lowered according to the operation of the wire 220 that is wound and unwound. At this time, as the wire 220 is wound, the panel assembly 100 may be shaken in the process of lifting or the panel assembly 100 may be shaken by an external force.

When the panel assembly 100 is not coupled to the housing 10 in a correct position in the up and down direction due to the shaking, the contact portion 131 may be affected by the shaking and thus the contact portion 131 may not press the intermediate member 70 in a correct position with respect to the up and down direction.

Accordingly, the contact portion 131 and the intermediate member 70 may not be electrically connected to each other, or a short circuit may occur. To prevent this, the air conditioner 1 according to an embodiment of the disclosure may include the guide 52 configured to guide the lifting direction of the panel assembly 100.

The guide 52 may guide the lifting direction of the panel assembly 100 to accurately move the contact portion 131 to a position in which the intermediate member 70 is arranged.

The guide 52 may be disposed on the support panel 50. Particularly, the guide 52 may be formed along the opening 50*a* of the support panel 50.

The guide 52 may include a guide surface 52*a* formed in a convex shape in the direction of the opening 50*a*. The guide surface 52*a* may be formed as a curved surface. The guide 52 may be formed on four inner edges of the support panel 50 forming the opening 50*a*, respectively.

In addition, the guide 52 may also be formed on four corners that is formed when the four inner edges of the support panel 50 are in contact to each other.

However, the disclosure is not limited thereto, and the guide 52 may be formed on at least two of the four inner edges and may be formed on at least two of the four corners.

As mentioned above, when the second filter 130 is inserted into the inside of the opening 50*a*, the panel assembly 100 may be coupled to the housing 10. The guide 52 formed along the opening 50*a* may guide the lifting direction of the second filter 130 and the frame 113 of the panel 110 configured to fix the second filter 130 to the panel 110 and thus the second filter 130 may be stably inserted into the opening 50*a*.

That is, when the panel assembly 100 is lifted while being shaken, the second filter 130 may be disposed on the outside of the opening 50*a* in the up and down direction, but the side surface of the second filter 130 may come into contact with the guide surface 52*a* and the lifting direction may be guided to the inside of the opening 50*a*.

In addition, when the second filter 130 is lifted while being shaken in the inside of the opening 50*a*, the side surface of the frame 113 may come into contact with the guide surface 52*a* so as to guide the lifting direction of the panel assembly 100, thereby allowing the second filter 130 to be lifted in the vertical direction.

The frame 113 may include a guide portion 114 provided to allow the panel assembly 100 to be stably guided along the guide surface 52*a* upon being in contact with the guide surface 52*a*.

The guide portion 114 may be provided in a tapered shape including a cross section thereof being reduced toward the upper side, or may be formed in a curved surface being concave toward the upper side. Therefore, when the guide portion 114 is in contact with the guide surface 52*a*, the guide portion 114 may be stably moved along the guide surface 52*a* and thus the lifting direction of the panel assembly 100 may be guided.

As described above, the contact portion 131 may be lifted while being arranged on the substantially same line as the intermediate member 70 in the up and down direction by the guide 52. The contact portion 131 may be stably in contact with the intermediate member 70 at a correct position, thereby forming the contact point.

Hereinafter a connection structure of the wire 220 and the panel assembly 100 will be described in detail.

Figure 9:
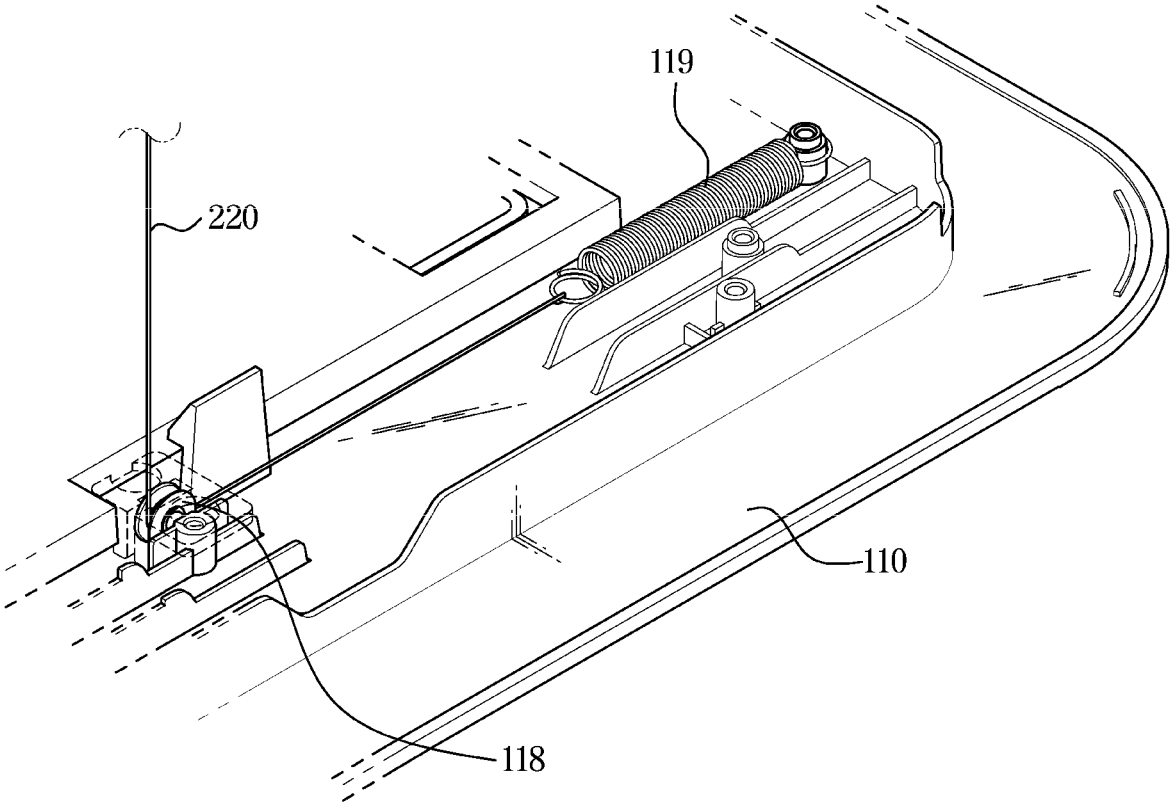
FIG. 9 is an enlarged view illustrating a part of configuration of the panel assembly of the air conditioner according to an embodiment of the disclosure.

FIG. 9 is an enlarged view illustrating a part of configuration of the panel assembly of the air conditioner according to an embodiment of the disclosure.

The wire 220 may be connected to the upper surface of the panel 110.

The panel 110 may include an elastic member 119 including one end connected to the other end of the wire 220 and the other end connected to the upper surface of the panel 110.

As mentioned above, the four wires 220 are provided, and accordingly, the four elastic members 119 may be provided to be connected to the other end of each wire 220.

The panel assembly 100 is supported by the four wires 220, and thus when the tension is not equally generated on the four wires 220, the panel assembly 100 may be lifted and lowered in an inclined state.

That is, when the panel assembly 100 is inclined to one side due to an external force generated during the lifting and lowering, or when a difference in a length of the wires 220 is generated due to a difference in a degree of winding or unwinding of each wire 220, the same tension may not be generated on the four wires 220.

Accordingly, the elastic member 119 may be coupled to the other end of each wire 220, and a magnitude of tension which may be different on the four wires 220 may be offset by the elastic force of the elastic member 119.

In addition, even when the difference in the length of the four wires 220 is generated, the elastic member 119 may be extended and contracted so as to offset the difference in the length of the four wires 220, thereby stably lifting and lowering the panel assembly 100.

The elastic member 119 may be provided as a coil spring. The elastic member 119 may be extended and biased in a direction perpendicular to the lifting and lowering direction of the panel assembly 100, thereby transmitting the elastic force in the direction perpendicular to the lifting and lowering direction of the panel assembly 100.

The panel 110 may further include a pulley 118 through which the other end of the wire 220 passes and configured to change an extending direction of the wire 220 into the horizontal direction with respect to the extending direction of the panel assembly 100.

The pulley 118 may be provided to correspond to the number of wires 220. Therefore, the air conditioner 1 according to an embodiment of the disclosure may include four pulleys 118.

The pulley 118 may be disposed on the upper surface of the panel 110. As described above, one end of the wire 220 may be connected to the motor 210 disposed in the inside 10*a* of the housing 10 and the other end of the wire 220 may be extended in the downward direction corresponding to the lowering direction of the panel assembly 100.

By the pulley 118, the extending direction of the other end of the wire 220 may be changed to the left and right direction or the front and rear direction perpendicular to the downward direction. That is, the other end of the wire 220 may be extended in the lifting and lowering direction of the panel assembly 100, and changed to a direction perpendicular to the lifting and lowering direction of the panel assembly 110 by the pulley 118.

Accordingly, the other end of the wire 220 may be connected to the elastic member 119, which is to be biased in the direction perpendicular to the lifting and lowering direction of the panel assembly 110, in a direction in which the elastic member 119 is biased.

The elastic member 119 may be extended and contracted in the direction perpendicular to the lifting and lowering direction of the panel assembly 100 when the difference in the tension or the difference in length is generated in each wire 220.

At this time, when the wire 220 is directly connected to the elastic member 119 without passing through the pulley 118, an elastic length of each elastic member 119 may be different from each other. Accordingly, the wire 220 may not horizontally lift and lower the panel assembly 100 but the wire 220 may lift and lower the panel assembly 100 in a state in which one side of the panel assembly 100 is inclined.

This is because a point in which the wire 220 and the panel 110 are connected is changed with respect to the direction perpendicular to the lifting and lowering direction of the panel assembly 100, according to the elastic length of the elastic member 119.

When it is assumed that a point in which the wire 220 is connected to the panel 110 in a constant state of the elastic member 119 is a point in which the panel assembly 100 is horizontally lifted and lowered, a point in which the wire 220 is connected to the panel 110 may be changed according to an extended state or a contracted state of the elastic member 119 and thus the panel assembly 100 may not be horizontally lifted and lowered.

However, through the pulley 118, it is possible to horizontally lift and lower the panel assembly 100 regardless of the elastic length of each elastic member 119. This is because, by the pulley 118, the wire 220 is connected to the panel 110 only at a point, in which the pulley 118 is arranged in the direction perpendicular to the lifting and lowering direction of the panel assembly 100, regardless of the elastic length of the elastic member 119.

In addition, by the pulley 118, the extending direction of the wire 220 may be guided from the lifting and lowering direction of the panel assembly 100 to the direction perpendicular to the lifting and lowering direction of the panel assembly 100. Therefore, the panel assembly 100 may be lifted and lowered while maintaining a level with respect to the ground.

The panel assembly 100 may be lifted and lowered while maintaining balance through the four wires 220. The panel assembly 100 may be lifted and lowered in the horizontal state through the four wires 220.

In addition, even when the external force is applied during the lifting and lowering of the panel assembly 100, the panel assembly 100 may be lifted and lowered while maintaining balance, through the four wires 220, the four elastic members 119 connected to the four wires 220, and the four pulleys 118 through which the four wires 220 passes.

Therefore, the panel 110, the first filter 120, and the second filter 130 may be always lowered to the range, in which a user can hold the panel assembly 100, in the horizontal state. Accordingly, a user can easily separate the first filter 120 and the second filter 130 from the panel 110 and easily couple the first filter 120 and the second filter 130 to the panel 110 again.

Hereinafter an intermediate member 80 of an air conditioner 1 according to another embodiment of the disclosure will be described. A configuration other than the intermediate member 80 described below is the same as the above-mentioned configuration of the air conditioner 1 according to an embodiment, and thus the description thereof will be omitted.

Figure 10:
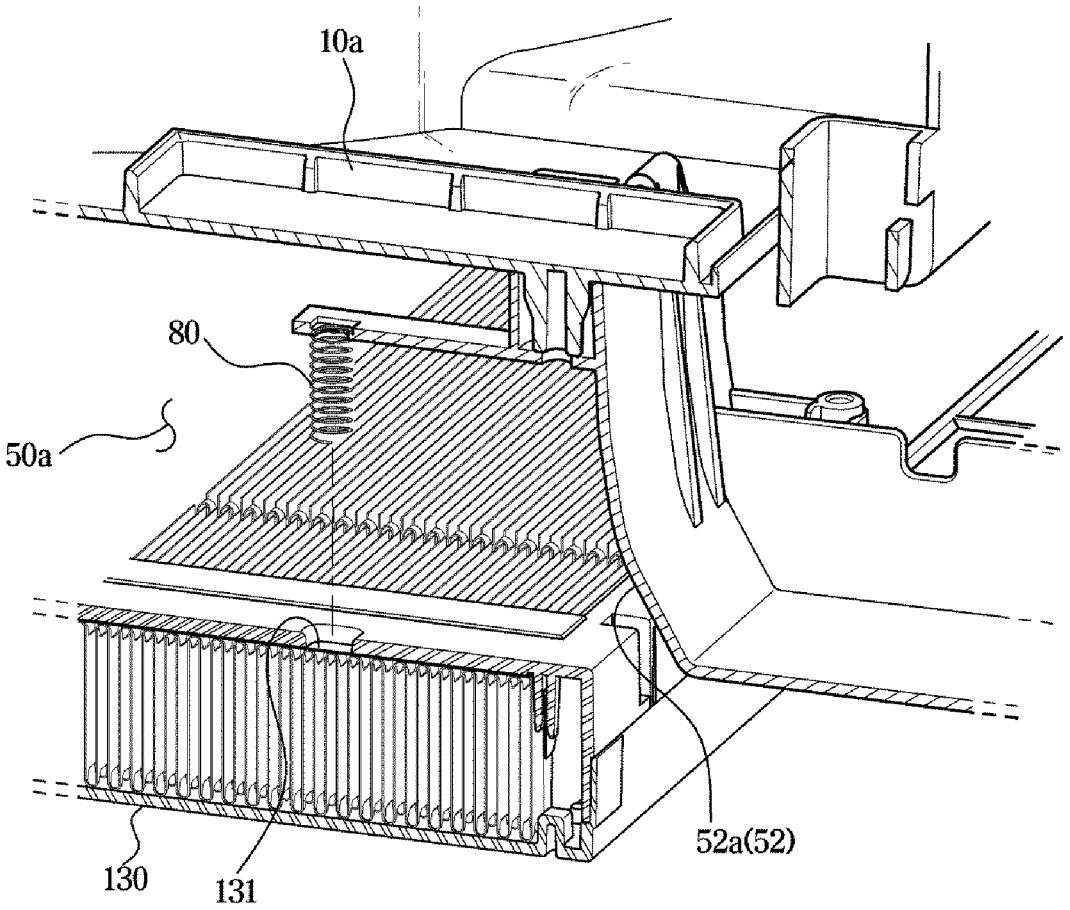
FIG. 10 is a cross-sectional perspective view illustrating a part of configuration when a panel assembly of an air conditioner according to another embodiment of the disclosure is lifted.

FIG. 10 is a cross-sectional perspective view illustrating a part of configuration when a panel assembly of an air conditioner according to another embodiment of the disclosure is lifted.

The intermediate member 80 may be provided in a coil spring shape. The intermediate member 80 may be provided to extend in a direction corresponding to a lifting and lowering direction of a panel assembly 100.

Accordingly, when a contact portion 131 is lifted and then comes into contact with the intermediate member 80, the contact portion 131 may press the intermediate member 80 upward and the intermediate member 80 may be biased downward so as to be in constant contact with the contact portion 131.

The contact portion 131 may press the intermediate member 80 while being moved upward, and thus the intermediate member 80 may be biased downward while being compressed upward.

Hereinafter a guide 53 of the air conditioner 1 according to another embodiment of the disclosure will be described. A configuration other than the guide 53 described below is the same as the above-mentioned configuration of the air conditioner 1 according to an embodiment, and thus the description thereof will be omitted.

Figure 11:
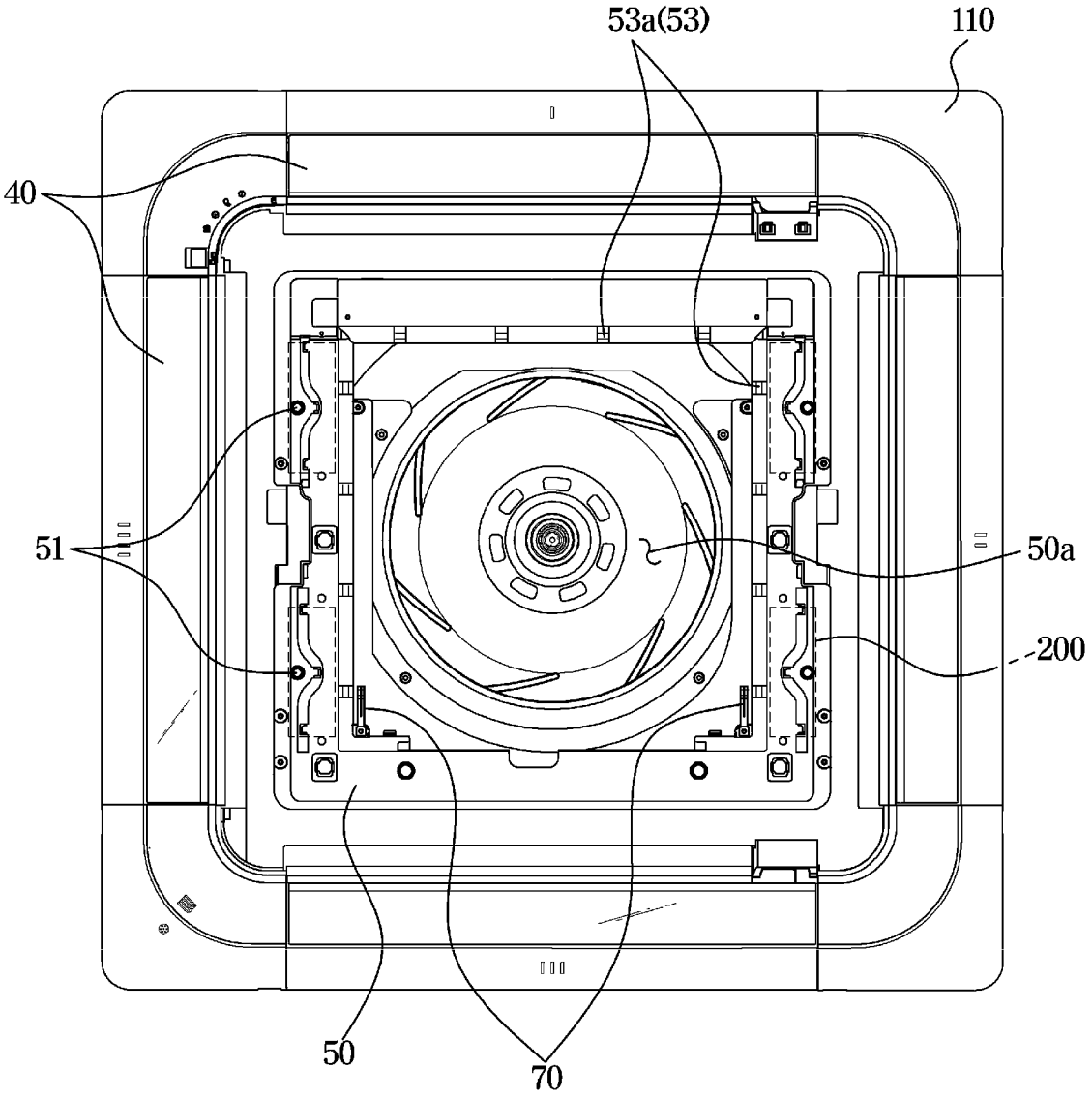
FIG. 11 is a bottom view illustrating a support panel of a housing of an air conditioner according to still another embodiment of the disclosure.
Figure 12:
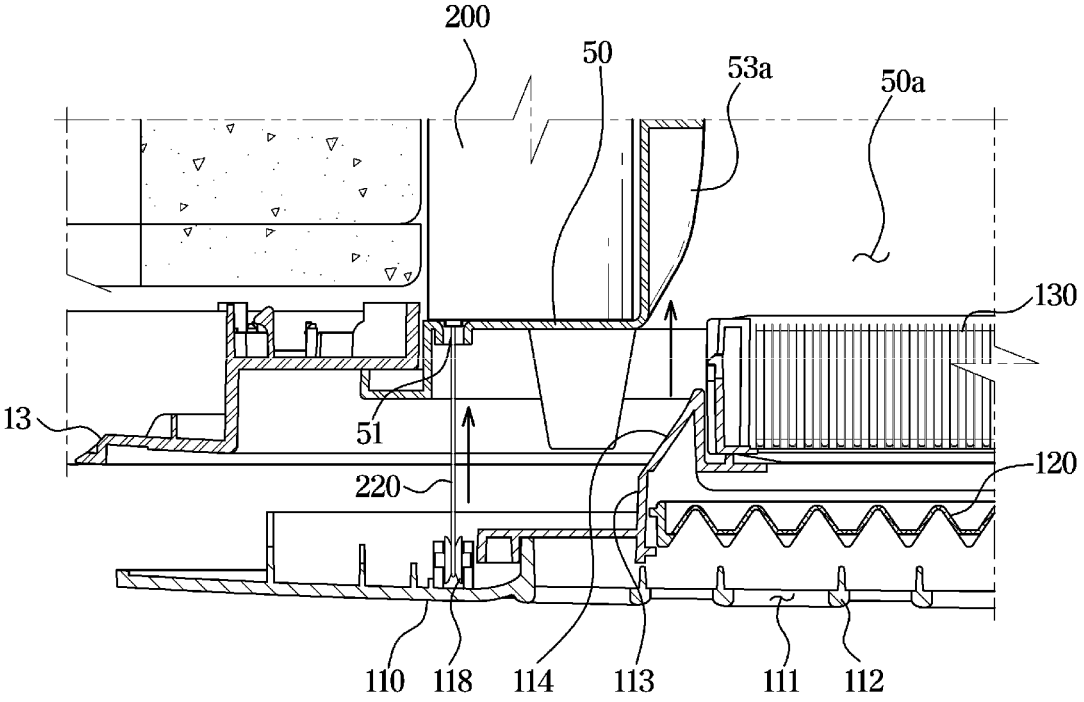
FIG. 12 is a cross-sectional view illustrating a part of configuration when a panel assembly of the air conditioner according to still another embodiment of the disclosure is lifted.
Figure 13:
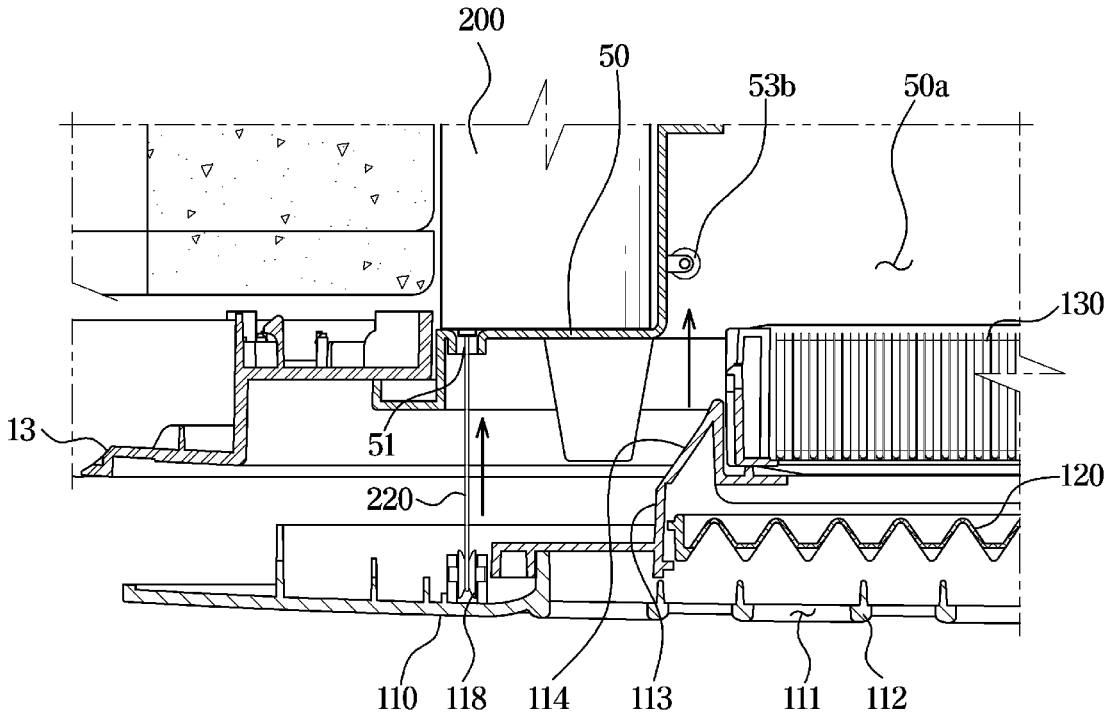
FIG. 13 is a cross-sectional view illustrating a part of configuration when the panel assembly of the air conditioner according to still another embodiment of the disclosure is lifted.

FIG. 11 is a bottom view illustrating a support panel of a housing of an air conditioner according to still another embodiment of the disclosure, FIG. 12 is a cross-sectional view illustrating a part of configuration when a panel assembly of the air conditioner according to still another embodiment of the disclosure is lifted, and FIG. 13 is a cross-sectional view illustrating a part of configuration when the panel assembly of the air conditioner according to still another embodiment of the disclosure is lifted.

As illustrated in FIGS. 11 and 12, the guide 53 may include a guide rib 53*a* formed to be convex toward a direction of an opening 50*a*. The guide rib 53*a* may be formed in a curve. The guide ribs 53*a* may be formed in plural on each of the four inner edges of a support panel 50 forming the opening 50*a*.

That is, the guide rib 53*a* may be provided to protrude toward a center direction of the opening 50*a* from an inner wall 50*b* of the support panel 50 forming the opening 50*a*.

When the panel assembly 100 is lifted while being shaken, the second filter 130 may be disposed on the outside of the opening 50*a* in the up and down direction, but the side surface of the second filter 130 may come into contact with the guide rib 53*a* and the lifting direction may be guided to the inside of the opening 50*a*.

In addition, when the second filter 130 is lifted while being shaken in the inside of the opening 50*a*, the side surface of the frame 113 may come into contact with the guide rib 53*a* so as to guide the lifting direction of the panel assembly 100, thereby allowing the second filter 130 to be lifted in the vertical direction.

In addition, as illustrated in FIG. 13, the guide 53 may include a guide roller 53*b* arranged on the inner wall 50*b* of the support panel 50.

The guide roller 53*b* may be provided as a pair on the inner wall 50*b* including at least two inner walls that is parallel to each other.

When the panel assembly 100 is lifted while being shaken, the second filter 130 may be disposed on the outside of the opening 50*a* in the up and down direction, but the side surface of the second filter 130 may come into contact with the guide roller 53*b* and the guide roller 53*b* may be rolled by the friction force.

The guide roller 53*b* may guide the second filter 130 to be lifted in a tangential direction of the roller of the guide roller 53*b* through rolling.

In addition, when the second filter 130 is lifted while being shaken in the inside of the opening 50*a*, the side surface of the frame 113 may come into contact with the guide roller 53*b* so as to guide the lifting direction of the panel assembly 100, thereby allowing the second filter 130 to be lifted in the vertical direction.

As is apparent from the above description, the air conditioner may include the electrostatic precipitator filter configured to be lifted and lowered along with the panel so as to allow a user to easily perform on maintenance on the electrostatic precipitator filter.

Further, because the electrostatic precipitator filter includes the contact portion configured to be in vertical contact with the power supply arranged on the housing, it is possible to easily supply power to the electrostatic precipitator filter when the panel and the electrostatic precipitator filter are lifted and then the panel is coupled to the housing.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. An air conditioner comprising:

a housing comprising an outlet;

a panel attachable to or detachable from a lower side of the housing, the panel comprising an inlet to introduce air therethrough;

a first filter installable to the panel to filter the introduced air;

a second filter installable to the panel at an upper side of the first filter and configured to further filter the introduced air; and a lifter configured to detach the panel from the lower side of the housing by lowering the panel from an initial position to a maintenance position, and to attach the panel to the lower side of the housing by lifting the panel from the maintenance position to the initial position, wherein in response to lowering the panel to the maintenance position by the lifter, one or more of the first filter and the second filter are accessible for the maintenance, wherein a lifting and lowering direction of the panel is parallel to a vertical direction, wherein the lifter comprises:

a motor; and four wires configured to lift or lower the panel, the first filter and the second filter by driving force of the motor, each of the four wires comprising a first end connected to the motor and a second end connected to the panel, wherein the first filter is configured to be detached from and installed to the panel in a first direction, wherein the second filter is configured to be detached from and installed to the panel in a second direction different from the first direction, wherein the first filter is detachable from the panel in a state in which the second filter is installed to the panel, and wherein the first filter is installable to the panel in the state in which the second filter is installed to the panel.

2. The air conditioner of claim 1, wherein the panel, the first filter and the second filter installed in the panel, is lifted or lowered in the vertical direction while maintaining a horizontal state.

3. The air conditioner of claim 1, wherein the panel further comprises a frame configured to support the first filter and the second filter against the panel, wherein the first filter is configured to be detached from and installed to the frame in the first direction, and wherein the second filter is configured to be detached from and installed to the frame in the second direction.

4. The air conditioner of claim 3, wherein the frame is formed at an upper side of the panel.

5. The air conditioner of claim 1, wherein the motor comprises four motors, and wherein each of the four wires is connected to a respective motor of the four motors.

6. The air conditioner of claim 1, wherein the panel comprises an elastic member comprising one end connected to the second end of the wire and another end connected to the panel.

7. The air conditioner of claim 6, wherein the panel further comprises a pulley through which the wire passes, and wherein the second end of the wire passes through the pulley and then is arranged perpendicular to the first end of the wire.

8. The air conditioner of claim 1, wherein the panel further comprises a guide configured to guide at least a part of the panel to move along the guide upon being in contact with the guide during the lifting of the panel so that a lifting direction of the panel is guided to be in the initial position.

* * * * *